US009468067B2

(12) United States Patent
Olariu

(10) Patent No.: US 9,468,067 B2
(45) Date of Patent: Oct. 11, 2016

(54) METHOD AND CIRCUIT ASSEMBLY FOR OPERATING AN LED LIGHT SOURCE

(71) Applicant: ZUMTOBEL LIGHTING GMBH, Dornbirn (AT)

(72) Inventor: Cristian Olariu, Dornbirn (AT)

(73) Assignee: ZUMTOBEL LIGHTING GMBH, Dornbirn (AT)

( * ) Notice: Subject to any disclaimer, the term of this patent is extended or adjusted under 35 U.S.C. 154(b) by 0 days.

(21) Appl. No.: 14/783,855

(22) PCT Filed: Apr. 23, 2014

(86) PCT No.: PCT/EP2014/058224
§ 371 (c)(1),
(2) Date: Oct. 10, 2015

(87) PCT Pub. No.: WO2014/173940
PCT Pub. Date: Oct. 30, 2014

(65) Prior Publication Data

US 2016/0066385 A1 Mar. 3, 2016

(30) Foreign Application Priority Data

Apr. 25, 2013 (DE) ..... 10 2013 207 525

(51) Int. Cl.
*H05B 33/08* (2006.01)

(52) U.S. Cl.
CPC ..... *H05B 33/0848* (2013.01); *H05B 33/0854* (2013.01)

(58) Field of Classification Search
None
See application file for complete search history.

(56) References Cited

U.S. PATENT DOCUMENTS

2006/0028155 A1* 2/2006 Young ..... H05B 33/0818 315/308
2006/0226956 A1 10/2006 Young et al.
2008/0258637 A1* 10/2008 Leung ..... H05B 33/0851 315/185 R (Continued)

FOREIGN PATENT DOCUMENTS

EP 1901587 A2 * 3/2008 ..... H05B 33/0848
EP 2242333 10/2010
WO 2009044340 4/2009
WO WO 2009044340 * 4/2009 ..... H05B 33/08

OTHER PUBLICATIONS

International Search Report for PCT/EP2014/058224, English translation attached to original, Both completed by the European Patent Office on Jul. 9, 2015, All together 5 Pages.

(Continued)

*Primary Examiner* — Dedei K Hammond
(74) *Attorney, Agent, or Firm* — Brooks Kushman P.C.

(57) ABSTRACT

A method for operating an LED light source, wherein the portion of the electrical power ($P_{out}$) fed to the LED light source during the operation that is converted into light ($P_{light}$) is determined on the basis of temperature measurements. On the basis thereof, a compensation factor ($K_{AGE\ COMPENSATION}$) that compensates the aging of the LED light source can be determined, wherein a correlation factor that was determined at the start of the putting into service of the lamp is taken into account in order to determine the portion of the electrical power converted into light ($P_{light}$).

10 Claims, 1 Drawing Sheet

(56) References Cited

U.S. PATENT DOCUMENTS

| | | | |
|---|---|---|---|
| 2010/0259198 | A1 | 10/2010 | Morgenbrod |
| 2010/0308833 | A1 | 12/2010 | Surdeanu et al. |
| 2011/0080113 | A1 | 4/2011 | Nguyen Hoang et al. |
| 2011/0309755 | A1 | 12/2011 | Wirth et al. |
| 2012/0013252 | A1 | 1/2012 | Eckel et al. |
| 2013/0249404 | A1 | 9/2013 | Eckel et al. |

OTHER PUBLICATIONS

Deurenberg et al. Proceedings of SPIE Sep. 7, 2005, vol. 5941, 12 Pages, XP 002428542, "Achieving color point stability in RGB multi-chip LED modules using various color control loops".

* cited by examiner

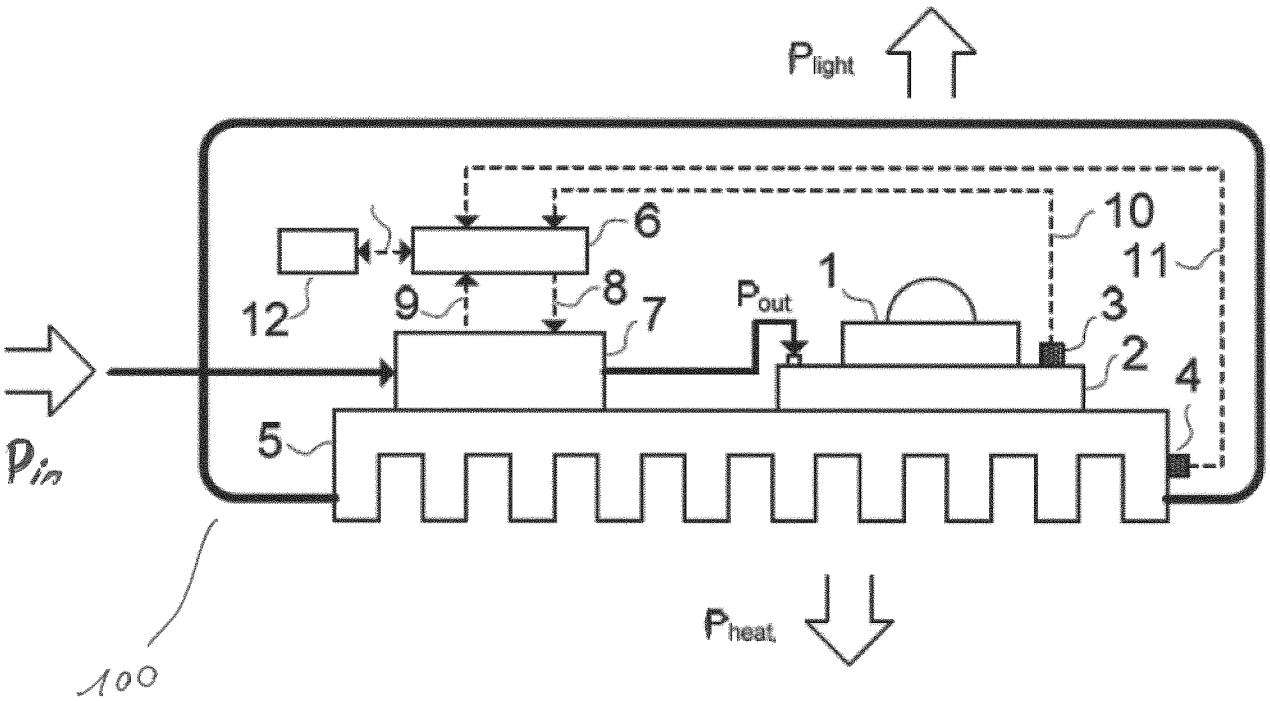
$P_{light}$
$P_{heat}$
$P_{out}$
$P_{in}$
1
2
3
4
5
6
7
8
9
10
11
12
100

METHOD AND CIRCUIT ASSEMBLY FOR OPERATING AN LED LIGHT SOURCE

CROSS-REFERENCE TO RELATED APPLICATION

This application is the U.S. national phase of PCT Application No. PCT/EP2014/058224 filed on Apr. 23, 2014, which claims priority to DE Patent Application No. 10 2013 207 525.1 filed on Apr. 25, 2013, the disclosures of which are incorporated in their entirety by reference herein.

The present invention relates to a method for operating an LED light source, with the aid of which ageing phenomena of the LED can be compensated for during operation in order to permanently ensure a uniform light output. The invention also relates to a corresponding circuit arrangement for carrying out the method.

All available LED light sources are currently subject to ageing phenomena which result in the light output dropping over the course of the service life. The severity of the drop may vary between the different LEDs and may be dependent, for example, on the technologies used during production and on the operating conditions; in spite of everything, this ageing effect is fundamentally present. This results in LED-based luminaires or light sources having a limited service life of usually approximately 50,000 operating hours. In this case, it is assumed that, after these 50,000 hours of operation, the light output has fallen to a limit value of below 70%—a limit value of 80% or 90%, for example, would also be conceivable—of the original value, for example.

The prior art discloses different procedures for taking account of this problem. The simplest variant involves not carrying out any compensation which takes account of the light drop when controlling the LEDs. In this case, the illumination is planned from the start such that the light output has a certain excess at the start of the activation of the luminaire and only at the end of the above-mentioned service life has the light output fallen to a value which corresponds to the actual desired illumination. That is to say, the light source is mostly operated in an overdimensioned manner such that it outputs too much light, which obviously results in reduced efficiency. In spite of everything, this procedure is still the most widespread for taking account of the phenomenon of the ageing of LEDs.

In addition, luminaires are also known in which the light output is immediately detected by a sensor and the light sources are then controlled as part of a regulating process in such a manner that a constant light output is achieved. However, this procedure is comparatively complicated on account of the sensor and a required optical system, with the aid of which light is reliably directed onto the sensor and influences of the outside light are eliminated in the process. Furthermore, there is the problem that a corresponding brightness sensor is also subject to ageing phenomena and accordingly it is not necessarily ensured here either that a desired light output is actually exactly maintained over the entire service life.

A third known procedure is based on the fact that the brightness drop over time is determined on the basis of statistical measurements and theoretical models. On the basis of these calculations, the light sources are then increasingly operated with increased power in order to counteract this effect. However, since these are theoretical models, many factors which influence the ageing phenomenon, for example temperature, humidity, parameters during operation and so on, may not be taken into account, with the result that this procedure also has a considerable amount of inaccuracy.

Finally, the prior art also discloses the practice of measuring the temperature of the LED and inferring the light output on the basis thereof. This procedure is based on the knowledge that, irrespective of ageing phenomena, the light output of an LED depends on its operating temperature. As mentioned, however, this is not an ageing effect, with the result that this is not taken into account at all in this variant.

Finally, the prior art has therefore hitherto not disclosed a method which ensures that the light output of an LED light source is maintained over its entire service life with sufficient reliability and with a reasonable amount of effort. Therefore, the present invention is based on the object of providing a remedy here and thereby optimizing the operation of LED light sources.

The object is achieved by means of a method for operating an LED light source having the features of claim 1 and by means of a circuit arrangement for operating an LED light source according to claim 7. The dependent claims relate to advantageous developments of the invention.

The invention therefore proposes a method for operating an LED light source, wherein the portion of the electrical power supplied to the LED light source during operation which is converted into light is determined on the basis of temperature measurements, preferably at two or more locations, and, on the basis thereof, a compensation factor which compensates for the ageing of the LED light source is determined, wherein a correlation factor which was determined at the start of the activation of the luminaire is taken into account in order to determine the portion of the electrical power which is converted into light.

An arrangement for operating an LED light source is also proposed, having a converter which is designed to convert power supplied on the input side into an output power supplied to the LED light source, and a control unit for controlling the converter, which control unit is designed to determine the portion of the electrical power supplied to the LED light source by the converter which is converted into light on the basis of temperature measurements, and, on the basis thereof, to determine a compensation factor which compensates for the ageing of the LED light source, wherein the control unit takes into account a correlation factor which was determined at the start of the activation of the luminaire in order to determine the portion of the electrical power which is converted into light.

The solution according to the invention is based on the fact that a drop in the light output of an LED light source results in a temperature increase in the LED or the so-called light engine, that is to say the components which emit light together with the LED. Since the supplied energy is not completely converted into light by a luminaire having LEDs, a particular portion of energy must inevitably be converted into heat inside the luminaire. In order to now ensure that the light output remains constant over the entire service life of the luminaire, the circuit arrangement according to the invention for operating the light source is designed to determine the ratios in which the supplied energy is converted into light and into heat. On the basis thereof, it is then possible to determine a compensation factor which is taken into account when supplying the power to the LEDs in order to compensate for the ageing effect. This requires the flow of heat from the luminaire to be monitored and, at the same time, knowledge of what power is supplied to the luminaire and is transmitted to the LEDs by the operating device or the circuit arrangement. In this case, depending on the configuration of the luminaire, power losses in the operating device and other components of the luminaire or light engine must likewise be taken into account so that the compensation factor can be correctly determined. This is because the operating device which is used to convert the energy provided by the general power supply into a supply current for the LEDs is usually likewise placed inside the luminaire, in which case this operating device may also result in certain losses which have an effect on the flow of heat.

Two or more temperature sensors which are placed along the heat transmission or heat dissipation path are preferably used to detect the magnitude of the heat loss. In this case, one sensor is preferably arranged in the immediate vicinity of the LEDs or the light engine, whereas the other sensor is arranged at a position at a distance therefrom inside the luminaire.

When determining the required compensation factor for compensating for the ageing phenomena, the circuit arrangement resorts here to information determined before activation and at the start of the activation of the luminaire. In this case, information indicating the efficiency with which the LEDs convert the electrical power supplied to them into light at particular temperatures is initially taken into account, for example. This is reference measurements which describe fundamental properties of the LEDs and can be carried out centrally, that is to say with a limited number of luminaires in the laboratory or immediately after their production, for example.

However, its actual installation situation may also be important during subsequent operation for the issue of what heat loss can occur during operation of the luminaire. Provision is therefore additionally made for the luminaire to carry out further measurements relating to the temperature behavior of the luminaire in the operating state as part of a self-calibration at the start of the activation. During these measurements, it can be assumed that ageing phenomena are not yet present in the LED light source here since the measurements are carried out at the start of operation of the luminaire and the period of time is comparatively short. On the basis of this information, the circuit arrangement can then calculate the magnitude of the portion of power which is converted into heat. In this case, these measurements possibly also take into account existing influences, for example losses in the operating device and the like. A correlation factor obtained in this manner is then in turn stored in a memory.

During the actual ageing of the LED light sources, that is to say during subsequent operation of the luminaire, the compensation already mentioned is then carried out. On the basis of the measurements using the two temperature sensors and the data determined during the advance measurements described above, it is then possible to determine the magnitude of the actual portion of heat loss. On the basis thereof, it is in turn possible to determine how much power is output by the LEDs as light and the manner in which the supplied power possibly needs to be adapted in order to achieve a constant light output. With this procedure, it is possible in this case to additionally take into account the initially mentioned temperature dependence of the light output of an LED which, as already mentioned, is independent of the ageing process.

Finally, a method is therefore proposed which can be used to compensate for ageing phenomena in LED light sources in a very efficient manner during operation of the luminaire. On the basis of a few measurements during actual operation, the light output of the LED can be determined very exactly and the supplied power can possibly be adapted in order to achieve a constant light output.

The invention shall be explained in more detail below using the accompanying drawing. In this case, the single FIG. 1 schematically shows a luminaire having an LED light source in which the method according to the invention is intended to be used.

The illustration in FIG. 1 should be understood in a purely schematic manner, in which case optical elements which influence the light output have not been illustrated, in particular. As already mentioned, the luminaire generally provided with the reference symbol 100 has an LED light source 1 which is arranged on an appropriate circuit board 2. A heat sink 5 which is intended to be used to efficiently dissipate heat loss occurring during operation of the luminaire 100 is situated on the rear side of the circuit board 2. In this case, the temperature measurements needed to determine the light output are carried out with the aid of two or more temperature sensors, in which case, in the present example, a first temperature sensor 3 is arranged as close as possible to the LED 1 or on the circuit board 2, whereas the second temperature sensor 4 is arranged in a position more remote therefrom. In the exemplary embodiment illustrated, the second temperature sensor 4 is arranged on the heat sink 5.

As schematically illustrated, the luminaire 100 is supplied with an input power $P_{in}$ which is converted into a corresponding output power $P_{out}$ by a converter 7. This output power $P_{out}$ is supplied to the light source, that is to say there is a corresponding connection between the converter and the printed circuit board 2 and the LED 1 arranged on the latter. In this case, the converter 7 is controlled using a luminaire control unit 6 which is responsible for ensuring operation with a uniform light output over the entire service life. In the present case, it is assumed here that a constant light output should always be understood as meaning a constant light output at maximum brightness or at a dimming value of 100%, for example. It goes without saying that it would also be possible to transmit dimming values to the luminaire 100 in order to change the brightness. However, in this case too, the intention is to achieve the situation in which a value of 40%, for example, fundamentally always results in a corresponding identical light output over the entire service life.

In this case, the converter 7 is controlled by the control unit 6 taking into account the measurement signals from the two temperature sensors 3 and 4 which are schematically illustrated with the reference symbols 10 and 11. A control signal 8 is also transmitted from the control unit 6 to the converter 7 and the converter 7 transmits information 9 relating to the input power $P_{in}$ and the power $P_{out}$ supplied to the LED light source by the converter 7.

A non-volatile memory 12 is also provided and stores the parameterization and calibration values described in more detail below. The control unit 6 can access this memory 12 in order to carry out the compensation according to the invention.

The procedure according to the invention for compensating for ageing phenomena of the light output of the LED is now as follows:

It is first of all assumed that the externally supplied power $P_{in}$ is converted either into light or into heat by the components of the luminaire 100, with the result that the following power balance applies:

$$P_{in}=P_{light}+P_{heat} \tag{1}$$

The heat loss $P_{heat}$ can be attributed both to losses in the converter 7 and to losses in the LED 1 or the light engine. Therefore, in order to determine the light power $P_{light}$, it is necessary to determine, in a first step, the manner in which the LED 1 converts power supplied at the start of its service life into light. The following equation applies to this:

$$P_{light}=\eta LED\cdot f(T_{L1})\cdot P_{out} \quad (2)$$

where $P_{light}$ corresponds to the light power output and, as already mentioned, $P_{out}$ is the power supplied to the LED 1 by the converter 7. $T_{L1}$ is the temperature at the location of the first sensor 3 and ηLED is the efficiency with which electrical power is converted into light by the LED 1 at a reference temperature. Since this conversion may be dependent on the temperature, as already mentioned, a further temperature-dependent factor $f(T_{L1})$ is also provided, in which case, in a first parameterization phase, the light power $P_{light}$ is then initially determined on the basis of the power $P_{out}$ supplied to the LED 1 at a reference temperature and the efficiency factor ηLED is therefore determined. The temperature-dependent parameter $f(T_{L1})$ is then additionally determined by means of measurements at further temperatures and for further supplied powers. The information obtained in this case is stored in the non-volatile memory 12.

As already mentioned, these initial measurements can be carried out in a few luminaires immediately after their production. In this case, the measurement results are to be regarded as independent of the actual place of use of the luminaire, with the result that they can be carried out centrally as it were and can then be stored in the memory.

A second measuring phase is required after installation of the luminaire 100 at the start of operation. This so-called self-calibration is used to determine effects in the light output and the heat conduction in the installed state of the luminaire. This is because the portion of power converted into heat taking into account the equations $$T_{LED}=T_{L1}+P_{heat}\cdot Rth_{LED\text{-}L1} \quad (3)$$

$$T_{LED}=T_{L2}+P_{heat}\cdot Rth_{LED\text{-}L2} \quad (4)$$

can be described as follows:

$$P_{heat}=(T_{L1}-T_{L2})/(Rth_{LED\text{-}L2}-Rth_{LED\text{-}L1}) \quad (5)$$

or $$P_{heat}=F\cdot(T_{L1}-T_{L2}) \quad (6).$$

In this case, $T_{LED}$ is the temperature of the LED itself, in which case $T_{L1}$ and $T_{L2}$ denote the temperatures at the measuring sensors 3 and 4. Furthermore, $Rth_{LED\text{-}L1}$ and $Rth_{LED\text{-}L2}$ each describe the thermal resistance between the LED and the location of the sensor 3 or the second sensor 4. Finally, F is the correlation factor which describes the relationship between the heat power output and the temperature measurements by the two sensors.

On the basis of the above equations 1, 2 and 6, this correlation factor can also be described as follows:

$$F=(P_{in}-\eta LED\cdot f(T_{L1})\cdot P_{out})/(T_{L1}-T_{L2}) \quad (7).$$

The correlation factor F can therefore be determined by means of temperature measurements since the further values are known from the original first measuring phase. In this case, it can be assumed that there are not yet any ageing phenomena in the LED 1 at this time. The information obtained in this case is then in turn stored in the memory 12 and is therefore available to the control unit 6.

If the LED 1 now ages over time during subsequent operation, its efficiency with regard to the conversion of supplied electrical power into light will change and the factor ηAGED_LED now applies instead of the original efficiency factor ηLED. On the basis of equations 1, 2 and 6 again, the following relationship then results:

$$F\cdot(T_{L1}-T_{L2})=P_{in}-\eta AGED_LED\cdot f(T_{L1})\cdot P_{out} \quad (8).$$

The new factor ηAGED_LED describing the reduced efficiency can then be described as follows:

$$\eta AGED_LED=(P_{in}-F\cdot(T_{L1}-T_{L2}))/(f(T_{L1})\cdot P_{out}) \quad (9).$$

It is obvious that—since all parameters on the right-hand side of the equation are known or can be measured—the reduced efficiency ηAGED_LED of the LED 1 can now again be determined in a simple manner by means of temperature measurements. This makes it possible to determine a compensation factor $K_{AGE_COMPENSATION}$ for compensating for the ageing phenomena on the basis of the following equation, in which case the control unit 6 must then control the converter 7 in a simple manner such that the output power $P_{out}$ is increased by this compensation factor.

$$K_{AGE_COMPENSATION}=\eta LED/\eta AGED_LED$$

With this procedure, as already mentioned, the ageing of the LED is primarily taken into account. However, the temperature dependence could also additionally be taken into account in the light output, which, as already mentioned, is independent of the ageing. For this purpose, a second compensation factor is introduced and is calculated as follows:

$$K_{TEMP_COMPENSATION}=f(T_{L1_REF})/f(T_{L1})$$

The values needed to calculate this compensation factor are already known from the parameterization measurements.

The procedure according to the invention is advantageous insofar as temperature effects which may result from the installation situation of the luminaire are also taken into account in this case. As a result of the fact that the calibration values are recorded immediately at the start of the activation of the luminaire, knowledge which takes into account the place of use of the luminaire is therefore available, with the result that it is possible to adapt the power in a particularly accurate manner in order to maintain a constant light output.

In this case, it should be taken into account that situations in which the behavior of the luminaire with respect to the heat dissipation fundamentally changes may also absolutely occur. For example, the luminaire might be newly installed at a different location during its service life, which results in the original results no longer being meaningful. In this case, provision may be made for a further self-calibration to be carried out after the luminaire has been newly installed in order to determine the new correlation factor on the basis of the LED efficiency determined last. Such a recalibration can be automatically carried out by the luminaire or can be initiated with the aid of a switch or by transmitting a corresponding control command, for example in the form of a DALI command.

However, such a new self-calibration may also be provided, for example, when the control unit determines a sudden change in the LED efficiency. The ageing of an LED is usually a very slow process, which is why a sudden change in the efficiency can indicate that the luminaire has been newly positioned or another event which decisively influences the flow of heat and therefore the calculated correlation factor has occurred. In order to nevertheless be able to determine a reliable compensation factor, the luminaire can then itself carry out a new calibration.

Ultimately, it is thus ensured that the light output of an LED light source in a luminaire is efficiently maintained at a constant desired value with a comparatively small amount of effort and by means of a few additional measures, in which case the ageing of the LED is compensated for here.

The invention claimed is:

1. A method for operating an LED light source, comprising:

a portion of the electrical power ($P_{out}$) supplied to the LED light source during operation which is converted into light ($P_{light}$) is determined on the basis of temperature measurements, and on the basis thereof, a compensation factor ($K_{AGE_COMPENSATION}$) which compensates for the ageing of the LED light source is determined, wherein a correlation factor (F) which was determined at the start of the activation of the luminaire is used to determine the portion of the electrical power which is converted into light ($P_{light}$);

wherein the correlation factor (F) is recalculated in the event of a new arrangement of the luminaire or in the event of a non-continuous change in the portion of power converted into light ($P_{light}$).

2. The method as claimed in claim 1, wherein the correlation factor (F) is determined by measuring the temperature at the start of the activation of the luminaire and on the basis of predetermined parameters.

3. The method as claimed in claim 2, wherein the predetermined parameters comprise an efficiency factor (ηLED) which describes the efficiency with which the LED light source before activation converts its supplied electrical power ($P_{out}$) into light ($P_{light}$).

4. A method for operating an LED light source, comprising:

a portion of the electrical power ($P_{out}$) supplied to the LED light source during operation which is converted into light ($P_{light}$) is determined on the basis of temperature measurements, and on the basis thereof, a compensation factor ($K_{AGE_COMPENSATION}$) which compensates for the ageing of the LED light source is determined, wherein a correlation factor (F) which was determined at the start of the activation of the luminaire is used to determine the portion of the electrical power which is converted into light ($P_{light}$);

wherein a correction factor ($K_{TEMP_COMPENSATION}$) which describes the temperature dependence of the light output of the LED light source is additionally calculated and used when controlling the LED light source.

5. The method as claimed in claim 4, wherein the temperature measurements are carried out using two temperature sensors, wherein one of the sensors is arranged in the vicinity of the LED light source and the other sensor is arranged more remotely from the LED light source.

6. An arrangement for operating an LED light source comprising:

a converter which is designed to convert power ($P_{in}$) on the input side into an output power ($P_{out}$) supplied to the LED light source, and a control unit for controlling the converter, wherein the control unit is designed to determine the portion of the electrical power ($P_{out}$) supplied to the LED light source by the converter which is converted into light ($P_{light}$) on the basis of temperature measurements, and, on the basis thereof, to determine a compensation factor ($K_{AGE_COMPENSATION}$) which compensates for the ageing of the LED light source, wherein the control unit calculates and uses a correlation factor (F) which was determined at the start of the activation of the luminaire in order to determine the portion of the electrical power which is converted into light ($P_{light}$);

wherein the control unit is designed to independently determine the correlation factor (F) by measuring the temperature at the start of the activation of the luminaire; and wherein the control unit is designed to recalculate the correlation factor (F) in response to an external control command and/or when a non-continuous change in the portion of power converted into light ($P_{light}$) is detected.

7. The arrangement as claimed in claim 6, wherein the control unit is designed to determine the correlation factor (F) on the basis of predetermined parameters which comprise an efficiency factor (ηLED) which describes the efficiency with which the LED light source before activation converts its supplied electrical power ($P_{out}$) into light ($P_{light}$).

8. The arrangement as claimed in claim 6, wherein the arrangement has a non-volatile memory which can be accessed by the control unit and which stores the correlation factor (F) and the predetermined parameters.

9. The arrangement as claimed in claim 6, wherein the arrangement has two or more temperature sensors, wherein one of the sensors is arranged in the vicinity of the LED light source and the other sensor is arranged more remotely from the LED light source.

10. An arrangement for operating an LED light source comprising:

a converter which is designed to convert power ($P_{in}$) supplied on the input side into an output power ($P_{out}$) supplied to the LED light source, and a control unit for controlling the converter, wherein the control unit is designed to determine the portion of the electrical power ($P_{out}$) supplied to the LED light source by the converter which is converted into light ($P_{light}$) on the basis of temperature measurements, and, on the basis thereof, to determine a compensation factor ($K_{AGE_COMPENSATION}$ which compensates for the ageing of the LED light source, wherein the control unit calculates and uses a correlation factor (F) which was determined at the start of the activation of the luminaire in order to determine the portion of the electrical power which is converted into light ($P_{light}$);

wherein the control unit is designed to independently determine the correlation factor (F) by measuring the temperature at the start of the activation of the luminaire; and wherein the control unit is designed to additionally calculate and use a correction factor ($K_{TEMP_COMPENSATION}$) which describes the temperature dependence of the light output of the LED light source when controlling the converter.

* * * * *